US006398568B1

(12) United States Patent
Preece et al.

(10) Patent No.: US 6,398,568 B1
(45) Date of Patent: Jun. 4, 2002

(54) SELF-TERMINATING ELECTRICAL CONNECTOR

(75) Inventors: William K. Preece, Morgantown, WV (US); Michael T. Jennison, Cranberry Township; Thomas A. Jennison, Pittsburgh, both of PA (US)

(73) Assignee: Greyfox Systems, Inc., Pittsburgh, PA (US)

( * ) Notice: Subject to any disclaimer, the term of this patent is extended or adjusted under 35 U.S.C. 154(b) by 0 days.

(21) Appl. No.: 09/401,177

(22) Filed: Sep. 22, 1999

Related U.S. Application Data

(63) Continuation-in-part of application No. 09/063,283, filed on Apr. 20, 1998, which is a continuation-in-part of application No. 08/905,177, filed on Aug. 4, 1997.

(51) Int. Cl.[7] ..... H01R 29/00
(52) U.S. Cl. ..... 439/188; 439/620
(58) Field of Search ..... 439/188, 620, 439/944; 333/242, 260; 200/51.1, 51.09, 51 R

(56) References Cited

U.S. PATENT DOCUMENTS

| | | | | | |
|---|---|---|---|---|---|
| 3,784,950 | A | * | 1/1974 | Coffman | 439/188 |
| 5,413,502 | A | | 5/1995 | Wang | 439/188 |
| 5,466,167 | A | * | 11/1995 | Scherer | 439/188 |
| 5,882,228 | A | * | 3/1999 | Kobler | 439/620 |
| 5,909,063 | A | * | 6/1999 | Silliman et al. | 307/112 |

FOREIGN PATENT DOCUMENTS

EP 0 393 670 10/1990

OTHER PUBLICATIONS

Bussey H E Et Al: "Service Architecture, Prototype Description, And Network Implications Of A Personalized Information Grazing Service" Multiple Facets Of Integration,San Francisco,Jun. 3–7, 1990 Institute Of Electrical And Electronic Engineers, pp. 1046–1053, XP000164339 see whole document.

Wyle M F: "A Wide Area Network Information Filter" Proceedings International Conference Artificial Intelligence On Wall Street, Oct. 9, 1991, pp. 10–15, XP000534152 see the whole document.

Lang K: "NewsWeeder: learning to filter netnews" Machine Learning, Proceedings Of The Twelfth International Conference On Machine Learning, Tahoe City, CA, USA, Jul. 9–12, 1995, San Francisco, CA, USA, Morgan Kaufmann Publishers, USA, pp. 331–339, XP002046557 see the whole document.

Rosenfeld L B, et al: "Automated Filtering Of Internet Postings" Online, vol. 18, No. 3, May 1994, pp. 27–30, XP000616769 see the whole document.

Yan T W, et al: "Sift—A Tool For Wide–Area Information Dissemination" Usenix Technical Conference, Jan. 16, 1995, pp. 177–186, XP000617276 see the whole document.

* cited by examiner

*Primary Examiner*—P. Austin Bradley
*Assistant Examiner*—Ross Gushi
(74) *Attorney, Agent, or Firm*—Webb Ziesenheim Logsdon Orkin & Hanson, P.C.

(57) ABSTRACT

The present invention relates to electrical connectors, and in particular to an electrical connector providing a means for establishing an automatic grounded termination point for the connector upon disconnection of the connector from an external signal source or receiving device. In the absence of an external electrical connection, the connector will be configured to establishing an automatic grounded termination point to eliminate the effects of stray capacitances, spurious extraneous signals and signal reflections on the circuitry connected to conductor. When coupled to an external connector, the connector ground connection will be broken to permit establishing a signal path for external circuitry. Also, a capacitive material can optionally be placed in series with the grounding resistive element assembly to block direct current to the resistive element in its grounded state that would otherwise overheat and damage the electrical resistor material.

25 Claims, 4 Drawing Sheets

SELF-TERMINATING ELECTRICAL CONNECTOR

CROSS-REFERENCE

This application is a continuation-in-part (CIP) of U.S. patent application Ser. No. 09/063,283 filed Apr. 20, 1998 which is a CIP of U.S. patent application Ser. No. 08/905,177 filed Aug. 4, 1997.

FIELD OF THE INVENTION

The present invention relates to electrical connectors, and in particular to an electrical connector providing a means for establishing an automatic grounded termination point for the connector upon disconnection of the connector from an external signal source or receiving device.

BACKGROUND OF THE INVENTION

In the transmission of radio frequency (RF) signals, it is undesirable to have unterminated or open connectors when the electrical connection to an external signal source or receiving device is broken, due to the potential that spurious extraneous signals, undesired signal emissions and signal reflections have for causing interference when circuitry termination points are left exposed and ungrounded. Because they are ungrounded, unterminated or open connectors allow the emission of such stray signals and cause unwanted signal reflection within the system. To eliminate this problem, the present invention provides a simple and inexpensive connector which can be automatically terminated to ground whenever it is disconnected from a mating connector.

Accordingly, it is an object of the present invention to provide an electrical connector to eliminate the effects of spurious extraneous signals, undesired signal emissions and signal reflections on the circuitry connected to the connector.

It is an additional object of the present invention to provide a simple and inexpensive connector which can be automatically terminated whenever it is disconnected from a mating connector.

It is an additional object of the present invention to provide electrical connector having means for establishing an automatic grounded termination point for the connector upon disconnection of the connector from an external signal source or receiving device.

SUMMARY OF THE INVENTION

The connector of the present invention is preferably comprised of an exterior shell made of a material with sufficiently high electrical conductivity and mechanical strength to permit mounting the connector to various types of mating connectors and other electrical devices as well as to act as a housing for the other components making up the connector. A lining made of an electrically insulating material is inserted into the shell. This lining mechanically secures and electronically isolates the shell from a center conductor located within the connector. The shell also serves as the means by which the electrical connection to ground is established for the self-termination feature of the invention.

One end of the exterior shell is preferably configured to be mounted to a circuit board, to a male or female coaxial F connector, or to any other signal carrying device or connector to permit establishing a semi-permanent connection between the connector and the device to which it is mounted. The other end of the exterior shell is preferably configured to establish a removable connection with a male coaxial F connector, BNC connector or any other similarly designed connector.

The center conductor is made of an electrically conductive material preferably having a spring characteristic. The center conductor can be made in a one piece or a two-piece fabrication. One end of the conductor is configured to be connected to a circuit board, to a male or female coaxial F connector, or to the signal carrying wire of any other signal carrying device or connector to establish a semi-permanent connection with the device to which the connector is mounted. The other end of the center conductor is configured to accomplish the self-termination feature of the present invention. This self-terminating end of the conductor preferably consists of at least two separable contactor pieces which are configured to have the tendency to be forced together in the absence of an external connection. The contactor pieces preferably contain at least two sets of tabs which are preferably angled such that they are forced together under spring-like pressure to form two wedges. In the absence of an external conductor element from another electrical device or connector, the wedge formed by one of the tab pairs holds a resistive element outward against the inside of the grounded exterior shell to provide an electrical connection between the center conductor and the exterior shell through a resistive element. Insertion of an external conductor element from another electrical device or connector into the wedge formed by the other set of tab pairs forces the contactor pieces to spread, thereby causing the center conductor to become ungrounded by breaking either the electrical connection between the resistive element and the center conductor or the connection between the resistive element and the exterior shell. The breaking of this ground connection allows a normal electrical connection to be established between the inserted external conductor element and the device to which the connector is mounted.

Also, a capacitive material can optionally be placed in series with the grounding resistive element assembly to block direct current to the resistive element in its grounded state that would otherwise overheat and damage the electrical resistor material.

Other details, objects, and advantages of the present invention will become apparent in the following description of the presently preferred embodiments.

DETAILED DESCRIPTION OF THE PRESENTLY PREFERRED EMBODIMENTS

Figure 1A:
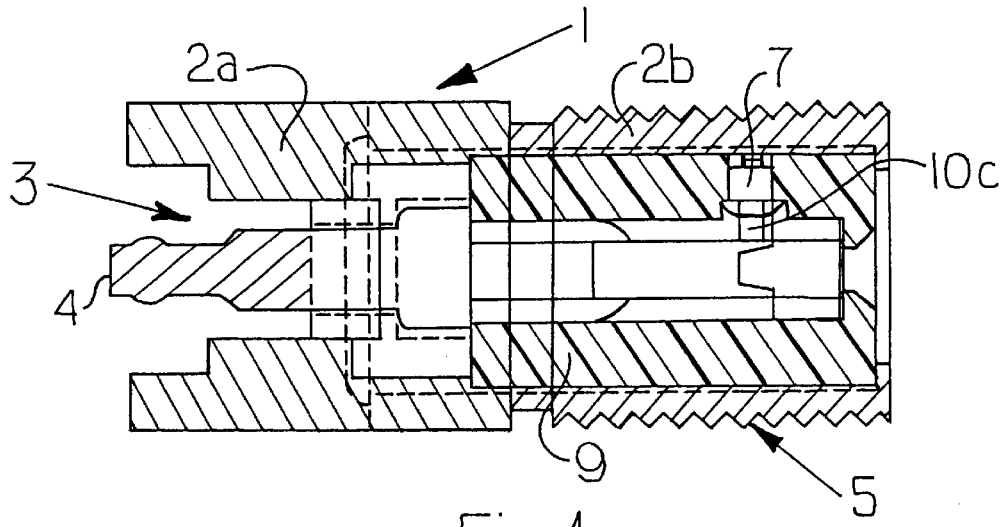
FIG. 1A is a longitudinal sectional view of the electrical connector of the present invention.
Figure 1B:
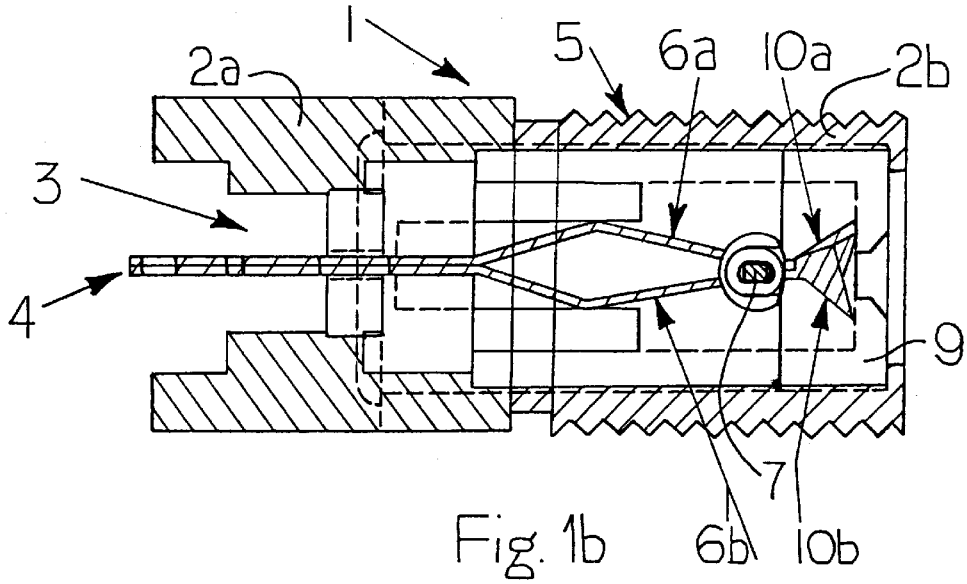
FIG. 1B is a longitudinal top plan view of the electrical connector of the present invention, as configured in a disconnected state.
Figure 1C:
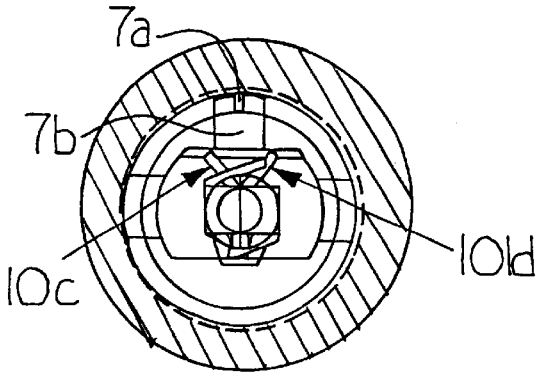
FIG. 1C is an axial sectional view of the electrical connector of the present invention, as configured in a disconnected state.

The preferred embodiment of the self-terminating electrical connector of the present invention is shown in FIGS. 1A through 1C. The connector 1 is preferably comprised of a one piece exterior shell 2 consisting of two sections 2*a* and 2*b* which couple the connector 1 to external circuitry and which also act as a protective shield for the components housed within the connector 1. The first section of the shell 2*a* has an exterior which is preferably configured for mounting the connector 1 to an electrical circuit board, or to a male or female coaxial F connector, or to any other signal carrying device or connector to permit establishing a semi-permanent connection between the connector and the device to which it is mounted (not shown), and contains an interior chamber 3 for housing the contacts of a conductor 4 that establishes the semi-permanent connection. The second section of the shell 2*b* has an exterior surface 5 adapted for establishing a removable connection with an external signal coupling, such as a male coaxial F connector, BNC connector or any other similarly designed connector, such as by threaded or push-on connection to the male end of a coaxial connector (not shown).

The exterior shell 2 is made of a material, preferably metal, with sufficiently high electrical conductivity and mechanical strength to permit mounting the connector to various types of mating connectors and other electrical devices as well as to act as a housing for the other components making up the connector, including copper, silver, gold, tungsten, graphite, iron, brass, zinc, iron, aluminum and steel and other similar materials. Shell sections 2*a* and 2*b* are preferably manufactured as a single piece, although a multiple piece construction is also possible. The exterior shell 2 is grounded in operation. Either section 2*a* or 2*b* can be configured for attaching the connector 1 to any type of commonly used external coupling, including threaded couplings, coaxial couplings and socket-type couplings. A lining 9 made of an electrically insulating material such as plastic, phenolic or rubber is inserted into the shell 2 to mechanically secure and electrically isolate the center conductor 4 from the exterior of the shell. This lining can either be fabricated in a single piece construction or it can be fabricated in multiple pieces for ease of installation.

The center conductor 4 is made of an electrically conductive material such as copper, silver, gold, tungsten, graphite, iron, brass, zinc, iron, aluminum and steel, and can be fabricated in either a one piece or a two-piece soldered configuration which preferably provides a spring characteristic. One end of the conductor 4 is configured to be connected to a circuit board, to a male or female coaxial F connector, or to the signal carrying wire of any other signal carrying device or connector to establish a semi-permanent connection with the device to which the connector is mounted. The center conductor 4 extends into the interior of the connector 1 and terminates in a multi-piece contactor 6 which is configured to accomplish the self-termination feature of the present invention by automatically establishing electrical contact with a grounded resistive element 7 when the conductor 6 is not coupled to an external connector 8. This self-terminating end of the conductor 6 preferably consists of at least two separable contactor pieces 6*a* and 6*b* which are configured to have the tendency to be forced together in the absence of an external connection 8. As shown in FIGS. 1B and 1C, the contactor pieces 6*a* and 6*b* preferably contain at least two sets of tabs 10*a*–10*b* and 10*c*–10*d* which are preferably angled such that they are forced together under spring-like pressure to form two wedges. In the absence of an external conductor element 8 from another electrical device or connector, the wedge formed by one of the tab pairs 10*c*–10*d* holds a resistive element outward against the inside of the grounded exterior shell 2 to provide an electrical connection between the center conductor 4 and the exterior shell 2 through a resistive element 7. In the preferred embodiment resistive element 7 is located at least partially outside shell interior 3 in order for it to establish the contact with shell exterior 2 that is necessary to create a physical or electrical connection between them as shell exterior 2 is located completely outside shell interior 3 to create a simultaneous connection between resistive element 7 and both conductor 4 and shell exterior 2 in order to establish the automatic ground termination. Insertion of an external conductor element 8 from another electrical device or connector into the wedge formed by the other set of tab pairs 10*a*–10*b* forces the contactor pieces 6*a* and 6*b* to spread thereby causing the center conductor 4 to become ungrounded by breaking either the electrical connection between the resistive element 7 and the center conductor 4 or the connection between the resistive element 7 and the exterior shell 2. The breaking of this ground connection allows a normal electrical connection to be established between the inserted external conductor element 8 and the device to which the connector 1 is mounted.

Figure 4A:
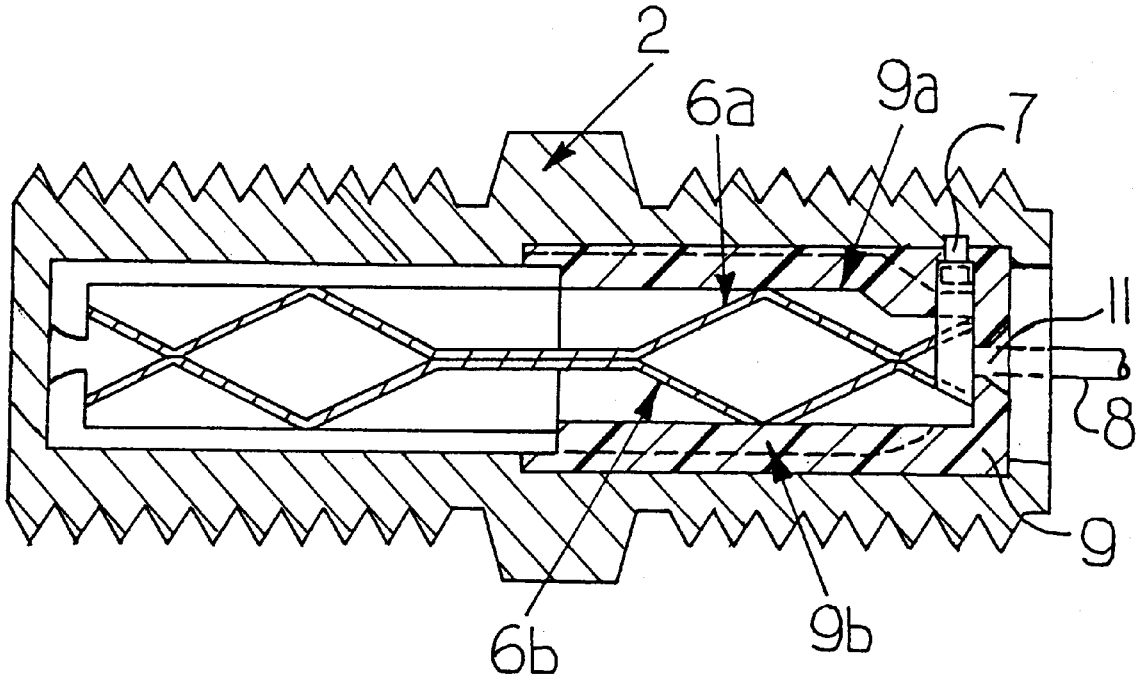
FIG. 4A is a longitudinal sectional view of the electrical connector of the present invention configured with an alternate design for the resistive element.
Figure 4B:
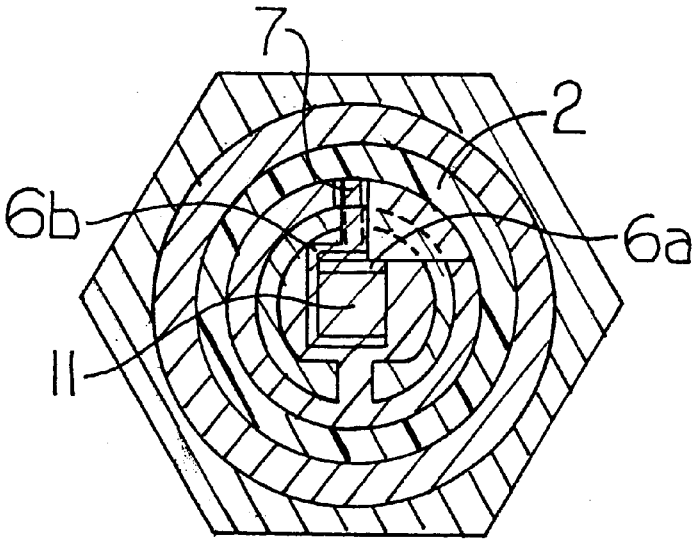
FIG. 4B is an axial sectional view of the electrical connector of the present invention with an alternate design for the resistive element, as configured in a disconnected state.

Although one embodiment utilizes a multi-piece conductor 6 with angled tabs forced together under spring-like pressure to form a wedge for contacting resistive element 7, it is understood that other configurations within the level of ordinary skill in the art for establishing a disconnectible contact between the conductor 6 and the resistive element 7 and/or between the resistive element 7 and the exterior shell 2 could be used. In the preferred embodiment, tabs 10 are in bent form to form a structure that operates to "wedge" an electrical contact between them by making contact with resistive element 7 in the absence of external conductor element 8 and by disestablishing such contact when external conductor element 8 is introduced, allowing movement from a closed to an open configuration to receive external conductor element 8 and vice versa by the action of a spring-like restoring force to engage (or disengage) the resistive element 7 to force (or release) it against (or from) the exterior shell 2. For example, as shown in FIGS. 4A and 4B, the resistive element 7 can either be attached to the exterior shell 2 such that removable contact is made with at least one of the conductor elements 6*a* or 6*b*, or resistive element 7 can be permanently attached to one of the contactor elements 6*a* or 6*b* such as by crimping, soldering or encapsulation. In the former configuration, the resistive element 7 will establish a ground connection with the exterior shell 2 when the conductor elements 6*a* and 6*b* are forced together in the absence of an external conductor element 8. When an external conductor element 8 is inserted into the opening 11 formed by the conductor elements 6*a* and 6*b*, the conductor elements 6*a* and 6*b* spread in such a manner as to disconnect from the resistive element 7 to disestablish the ground connection. In the latter configuration, the resistive element 7 will again establish a ground connection with the exterior shell 2 when the conductor elements 6*a* and 6*b* are forced together in the absence of an external conductor element 8. However, when an external conductor element 8 is inserted into the opening 11 formed by the conductor elements 6*a* and 6*b*, the conductor elements 6*a* and 6*b* spread in such a manner as to disconnect the resistive element 7 from the exterior shell 2 to disestablish the ground connection. In either configuration, the desired movement of the conductor elements 6*a* and 6*b* can be achieved by configuring the insulator 9 with a protrusion 9*a* and a groove or indentation 9*b* to respectively limit and expand the travel of the associated conductive element 6*a* or 6*b* in such a manner as to cause the ground connection to be broken when the external conductor element 8 forces conductor elements 6*a* and 6*b* apart. Groove or indentation 9*b* can also act to restrict rotation of center conductor element(s) 6*a* and/or 6*b*. For example, in FIG. 4A, conductor element 6*b* pulls resistive element 7 away from the exterior shell 2 through the combined effect of protrusion 9*a* limiting the travel of conductor element 6*a* and groove 9*b* expanding the travel of conductor element 6*b*, which together causes enough deflection of resistive element 7 to accomplish disconnection from exterior shell 2.

Figure 3A:
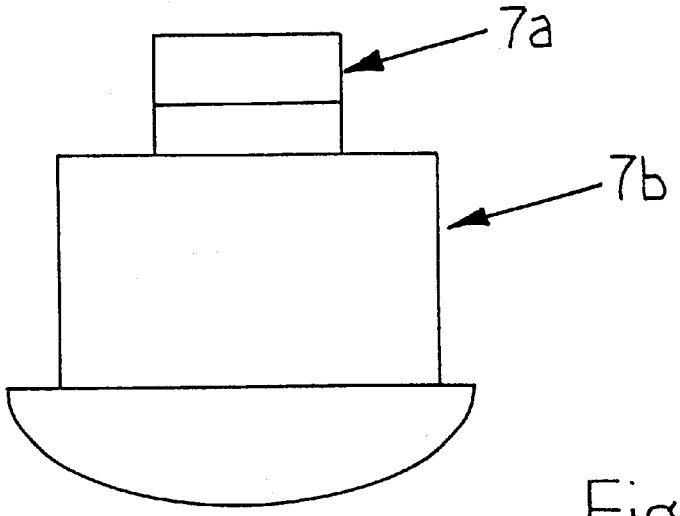
FIG. 3A is a sectional view of the grounded resistive element of the present invention.
Figure 3B:
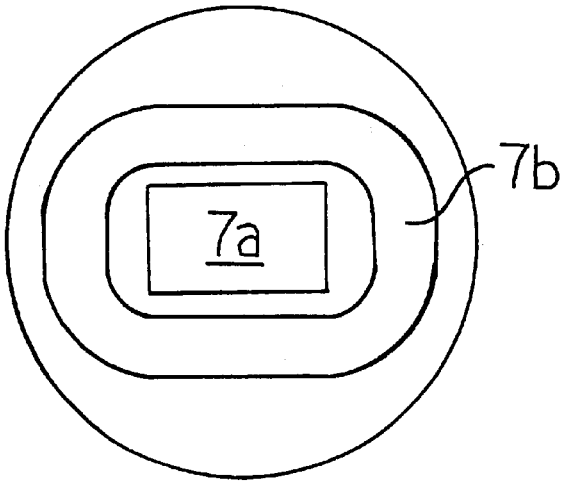
FIG. 3B is a top plan view of the grounded resistive element of the present invention.
Figure 3C:
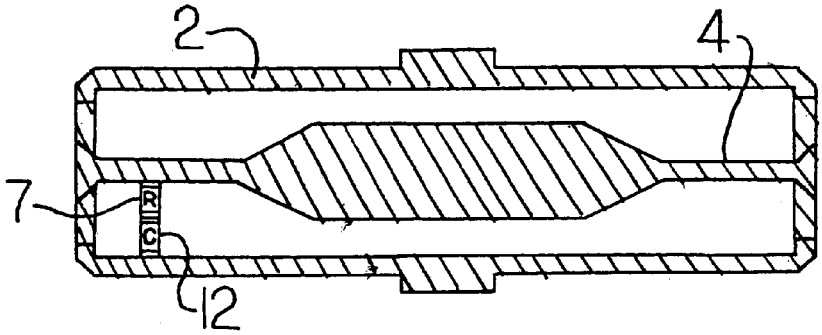
FIG. 3C shows a capacitive material optionally placed in series with the resistive element assembly.

As shown in FIGS. 3A and 3B, the resistive element 7 is preferably made as a two-piece assembly 7*a* and 7*b* using an electrically conductive material such as copper and a standard electrical resistor material. An alternative would be to make the resistive element as one piece from a material that provides the desired resistance. Connectors could be manufactured with various resistive elements to provide any resistance that would be required so as to match the designed impedance of the system in which it is being used Preferably the resistive element 7 has a resistance value of approximately 75 Ohms to allow use of the connector 1 with cable television systems. As shown in FIG. 1C, top contact 7*a* makes contact with the exterior shell 2 to establish a connection to ground, and bottom contact 7*b* has an end configured to form an electrical connection with the wedge formed by the angled tabs of contactor pieces 10*c* and 10*d*. A design variation could utilize a spring to force the resistive element 7 against the center conductor 4 in the absence of an external connector 8. An alternate design variation could utilize a configuration which ensures that the resistive element 1 remains in contact with the exterior shell 2 at all times. Also, as shown in FIG. 3C a capacitive material 12 can optionally be placed in series with the grounding resistive element assembly 7 to block direct current to the resistive element in its grounded state that would otherwise overheat and damage the electrical resistor material.

Figure 2A:
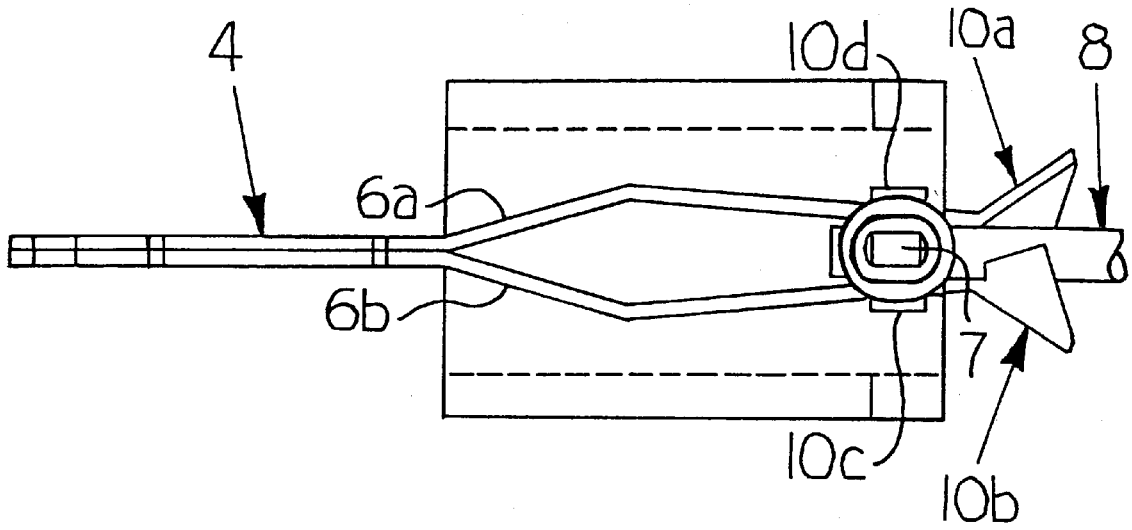
FIG. 2A is a longitudinal top plan view of the electrical connector of the present invention, as configured for connection to an external signal transmission line.
Figure 2B:
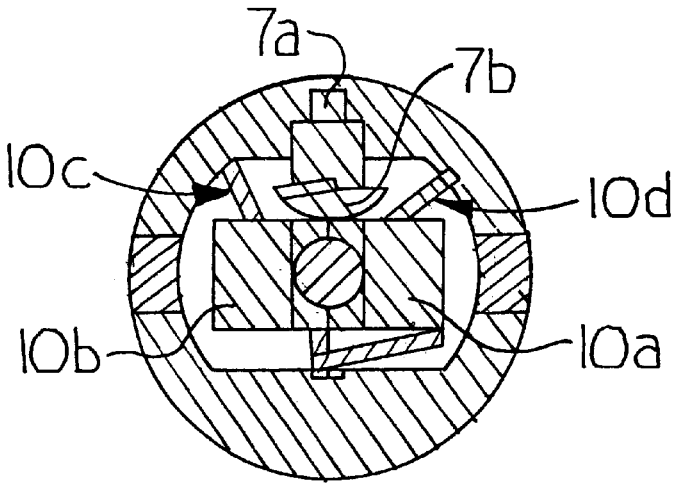
FIG. 2B is an axial sectional view of the electrical connector of the present invention, as configured for connection to an external signal transmission line.

In the absence of an external electrical connection 8, connector 1 will be configured as shown in FIG. 1B, thereby establishing an automatic grounded termination point for the connector 1. A grounded termination is desirable upon disconnection of the connector 1 from an external signal coupling in order to eliminate the effects of spurious extraneous signals, undesired signal emissions and signal reflections on the circuitry connected to conductor 4. When the connector 1 is introduced to the male end of an external connector 8, the contactor sections 6*a* and 6*b* are forced apart as shown in FIGS. 2A and 2B, causing the electrical contact between tabs 10*c* and 10*d* and the resistive element 7 to be broken, thereby disconnecting conductor 4 from ground and establishing a signal path between the external connector 8 and the circuitry connected to conductor 4.

While presently preferred embodiments of practicing the invention has been shown and described with particularity in connection with the accompanying drawings, the invention may otherwise be embodied within the scope of the following claims.

What is claimed is:

1. An electrical connector having an electrically conductive exterior shell, said shell having an internal surface which surrounds an interior space of the connector to house a plurality of electrical components, and wherein said shell has two ends which are configured to couple said connector to a plurality of external circuits, and wherein said electrical components comprise:

A. a conductor located within said interior space and comprising a pair of terminals, wherein:

(i) a first terminal is located at a first end of said shell for establishing an electrical connection to a first external circuit; and (ii) a second terminal is located at a second end of said shell for establishing an electrical connection to a second external circuit;

B. a lining located within said interior space for securing and isolating said electrical components from said exterior shell, wherein said lining contains an opening which is in communication with said electrical components when said opening is also in communication with said internal surface of said exterior shell; and C. a resistive element configured to establish an electrical contact with said exterior shell and at least one of said terminals when an electrical connection to at least one external circuit is broken, wherein said resistive element is mounted to the surface of at least one of said terminals to permit said electrical contact to be established by insertion of the resistive element at least partially through the opening in said lining to contact said exterior shell;

wherein said resistive element is moveable such that said electrical contact is made and broken by movement of said resistive element.

2. The electrical connector of claim 1, wherein said electrical contact between said resistive element and said exterior shell is broken when an electrical connection to said first or second external circuit is made.

3. The electrical connector of claim 1, wherein said electrical contact between said resistive element and said exterior shell is not broken when an electrical connection to said first or second external circuit is made.

4. The electrical connector of claim 1, wherein said exterior shell is grounded.

5. The electrical connector of claim 1, wherein at least one said end is configured to mate with a coupling selected from the group consisting of a threaded coupling, a coaxial coupling and a socket coupling.

6. The electrical connector of claim 1, wherein said lining is comprised of an electrically insulating material.

7. The electrical connector of claim 1, wherein said resistive element has a resistance of approximately 75 ohms.

8. The electrical connector of claim 1, wherein said connector eliminates the effects of undesired signals on said first or second external circuit.

9. The electrical connector of claim 1, wherein said connector provides an automatic termination for said conductor through said resistive element.

10. The electrical connector of claim 1, wherein said resistive element is formed in one piece.

11. The electrical connector of claim 1, wherein said resistive element comprises a two-piece assembly with one of said pieces being formed of an electrically conductive material and with the other of said pieces being formed of an electrically resistive material.

12. The electrical connector of claim 1, further comprising a capacitive material placed in series with said resistive element.

13. The electrical connector of claim 12, wherein said capacitive material blocks direct current to said resistive element in its grounded state.

14. The electrical connector of claim 1, wherein said terminals comprise separable pieces which form said electrical contact with said resistive element in the absence of an electrical connection with said first or second external circuit.

15. The electrical connector of claim 14, wherein said pieces are disconnected from said resistive element when an electrical connection to said first or second external circuit is made.

16. The electrical connector of claim 14, wherein said pieces are not disconnected from said resistive element when an electrical connection to said first or second external circuit is made.

17. The electrical connector of claim 14, wherein said pieces have a plurality of tabs to permit said resistive element to electrically connect to said exterior shell.

18. The electrical connector of claim 1, wherein the first end of said shell is configured for mounting said connector to a device selected from the group consisting of an electrical circuit board and a coaxial connector.

19. The electrical connector of claim 18, wherein the second end of said shell is configured for establishing a removable connection between said connector and said external circuit.

20. The electrical connector of claim 1, wherein said first or second terminal comprises two separable pieces wherein one of said pieces forms said electrical contact with said resistive element in the absence of an electrical connection with said first or second external circuit.

21. The electrical connector of claim 20, wherein said piece in contact with said resistive element is disconnected from said resistive element when an electrical connection to said first or second external circuit is made.

22. The electrical connector of claim 20, wherein said piece in contact with said resistive element is not disconnected from said resistive element when an electrical connection to said first or second external circuit is made.

23. The electrical connector of claim 22, wherein said electrical connection between said resistive element and said exterior shell is broken when an electrical connection to said first or second external circuit is made.

24. The electrical connector of claim 20, wherein said lining includes a protrusion for limiting movement of one of said pieces when an electrical connection to said first or second external circuit is made.

25. The electrical connector of claim 24, wherein said lining includes an indentation or groove structurally configured for either expanding movement or restricting rotation of one of said pieces when an electrical connection to said first or second external circuit is made.

* * * * *

UNITED STATES PATENT AND TRADEMARK OFFICE

CERTIFICATE OF CORRECTION

PATENT NO. : 6,398,568 B1 
DATED : June 4, 2002
INVENTOR(S) : William K. Preece et al.

It is certified that error appears in the above-identified patent and that said Letters Patent is hereby corrected as shown below:

Title page,
Item [75], Inventors, add -- Dale Pfiefer, Washington, PA --.

Signed and Sealed this

Fifteenth Day of April, 2003

JAMES E. ROGAN
*Director of the United States Patent and Trademark Office*